United States Patent [19]

Szymanski

[11] Patent Number: 4,765,379

[45] Date of Patent: Aug. 23, 1988

[54] PLUG AND OUTER CAP FOR CLOSING A CONTAINER

[75] Inventor: Patrice Szymanski, Montrichard, France

[73] Assignee: Laboratoires de Pharmacologie Homeopathique Dolisos - Laboratoires Jean Tetau, Paris, France

[21] Appl. No.: 134,938

[22] Filed: Dec. 18, 1987

[30] Foreign Application Priority Data

Jul. 3, 1987 [FR] France ..... 87 09480

[51] Int. Cl.[4] ..... B65D 41/28

[52] U.S. Cl. ..... 141/381; 206/538; 206/540; 215/6; 215/228; 215/230

[58] Field of Search ..... 206/538, 540; 220/23; 141/381, 325; 215/6, 228, 230

[56] References Cited

U.S. PATENT DOCUMENTS 2,264,827 12/1941 Christensen ..... 220/23 X
2,663,450 12/1953 Bourcart ..... 220/23

FOREIGN PATENT DOCUMENTS 2581036 10/1986 France .

*Primary Examiner*—Donald F. Norton
*Attorney, Agent, or Firm*—Becker & Becker, Inc.

[57] ABSTRACT

The plug includes a lower tubular element penetrating into an upper portion of the container and an upper element provided for being covered by an outer cap. A bottom of the tubular element is formed with cells and a top of the upper element is formed with an upper circular recess also having cells. The cells are provided for temporarily retaining pharmaceutical granules.

12 Claims, 1 Drawing Sheet

PLUG AND OUTER CAP FOR CLOSING A CONTAINER

FIELD OF THE INVENTION

In French Pat. No. 85 06351 published under No. 2,581,036 there has been described a plug for closing containers such as tubes or flasks, and particularly containers for pharmaceutical products, this plug being made of two elements providing both a protection against ambient atmosphere and a burglar-proof character for the container.

The plug thus defined includes a lower tubular element penetrating into the tubular portion of the container and being prolongated, at its upper portion, by a plane horizontal wall forming a lid, this plane horizontal wall having on its peripheral outer edge a flared out portion or a ring cooperating with recesses or bulges arranged on the inner portion of the cap or of the skirt of the outer cap placed on the container and providing for the burglar-proof character.

Now, it has been found that such plugs met perfectly the standards in force for the closing of containers containing pharmaceutical products when presented in the shape of small spheres as homeopathic pharmaceuticals, so that these homeopathic pharmaceuticals could be taken from inside the container without being touched in order to retain all their efficiency.

However, the patient finds it very difficult to place, in the lower tubular element forming a plug, the exact prescribed number of granules, for example two or three granules, and, therefore, the patient is led to handle several times the lower tubular element and risks to loose a part of the granules contained therein.

OBJECT OF THE INVENTION

An object of the present invention is to remedy these disadvantages by providing an inner tubular element of the plug, with the upper face formed with three pockets or cells while the lower face is formed with two cells, thereby allowing maintaining temporarily the number of granules necessary since, even if the patient has taken out more than two or three granules, he can easily reintroduce the granules in excess in the container, so that the two or three necessary granules remain in the bottom of the plug inner tubular element by being maintained by the cells.

SUMMARY OF THE INVENTION

According to the invention, a plug which provides for the closing of containers such as tubes and flasks, particularly containers for pharmaceutical granules, is made of two portions providing respectively for a protection against ambient atmosphere and a burglar-proof character of the container, includes a lower tubular element penetrating into the upper portion of the container and an upper element provided for being covered by an outer cap and formed on its peripheral outer edge with a flared out portion or ring cooperating with recesses beads or bulges placed on an inner portion of the cap, and wherein a bottom of the tubular element is formed with cells, and a top of the upper element is formed with an upper circular recess having cells, the cells being provided for temporarily retaining pharmaceutical granules in order to facilitate an intake of drugs in a shape of small spheres and particularly homeopathic drugs.

Various other features of the invention will become more apparent from the following detailed description.

BRIEF DESCRIPTION OF THE DRAWINGS

Embodiments of the invention are shown by way of non limiting examples in the accompanying drawings, wherein.

DESCRIPTION OF PREFERRED EMBODIMENTS

Figure 1:
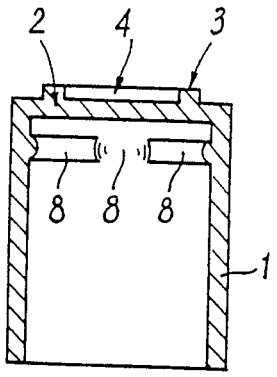
FIG. 1 is a diametrical cross-sectional elevation view of a first embodiment of the outer cap for a plug according to the invention.

Referring now to the drawings, FIG. 1 shows a diametrical sectional view of an outer cap 1 which is composed of a tubular element closed at its upper portion by a top 2 having in the present case an outer circular edge 3 thus defining in the middle of top 2, a space 4 which can receive for example a circular label with an indication of the product contained in the container, which can be a flask or a tube.

The container, once filled and sometimes subjected to a treatment drying up the atmosphere of the tube or flask, is closed by a plug 5 (FIG. 2) made of a horizontal plane surface 6 prolongated at its lower portion by a skirt 7 of a slightly frustoconical outer shape which facilitates its engagement inside the tube or neck of the flask.

The plane surface 6 is prolongated by an overthickness **6*a* with flared out peripheral edges 6*b*** coming to rest on the top of the tube or of the neck of the flask, thereby ensuring tightness of the container with respect to the outer atmosphere.

Moreover, the flared out peripheral edge **6*b* of the plug 5 cooperates with inner recesses or beads 8 placed in the present case at 90° with respect to each other and formed in the inner wall of the upper cap. The recesses or beads 8 are formed by molding when the cap is made of a moldable plastic material. When the plug 5 is in position on the container and by engaging the outer cap 1 on the upper portion of the container, the flared out peripheral edge 6*b*, by a slight deformation thereof, is positioned between the bottom of the top 2 and the upper portion of the inner recesses or beads 8**.

There is thus obtained a perfectly tight closing of the container which contains for example a homeopathic drug.

The validity period of the drug is thus lengthened since the container walls are opaque and form a barrier against noxious radiations.

For opening the container, one pulls the outer cap 1, leaving the plug 5 in position since the peripheral edge **6*b* gets disengaged from the inner recesses or beads 8. Actually, the maintenance force of the skirt 7 of the plug 5 inside the container is higher than the resistance of the edge 6*b* with respect to the inner recesses or beads 8 of the cap 1**.

Once the cap 1 has been removed, the plug 5 is manually taken away by hand. The reverse operation is made for closing the flask.

Figure 3:
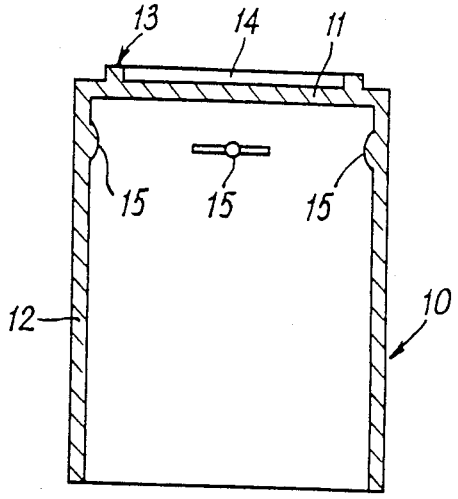
FIG. 3 is a diametrical cross-sectional elevation view of a second embodiment of the outer cap.

In FIG. 3, the cylindrical shaped cap 10 is formed with a horizontal top 11 with a periphery bounded by a skirt 12 as in the previous case; the top 11 includes also a circular edge 13 defining a space 14.

Inside, the skirt 12 is formed, in its upper portion, with bulges 15 disposed in the present case at 90° with respect to one another in order to encompass the plug 17 having a lower tubular portion 17*a* (FIG. 4) for penetrating into the neck of the flask or into the top of the tube. The bulges 15 (as well as the recesses or beads 8 of FIG. 1) can be disposed at will at 90°, 120° or 180° with respect to one another.

As in the preceding case, the plug 17 is supplied by being rigidly connected to the cap 10 so that the plug 17 and cap 10 can be put in position on the container in a single operation, thereby saving a lot of time and allowing also to realize a closing of the container with an automated machine.

Figure 2:
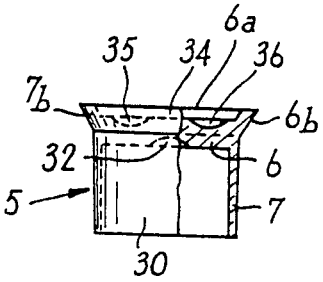
FIG. 2 is an elevation view, partly in cross-section, of a plug used with the cap of FIG. 1.

The operation of this closure is identical to that described for the previous case of FIGS. 1 and 2.

In both cases, when opening the container and due to the fit between the flared out edge 6*b*(plug 5) and the inner recesses or beads 8 of the cap 1, or between the ring or rings 19 and the bulges 15 (cap 10, plug 17), each cap 1 or 10 is disconnected from the container before the plug 5 or 17 (which is imparted with a higher disengagement resistance) is extracted from the tube or flask, and there is therefore no risk of inadvertently spilling the products contained in the tube or flask.

The caps and plugs hereabove described are made of any convenient material, compatible with the container and the product to be protected, but in general they are made of natural or synthetic plastic materials by molding so as to obtain products of a very good quality.

Figure 6:
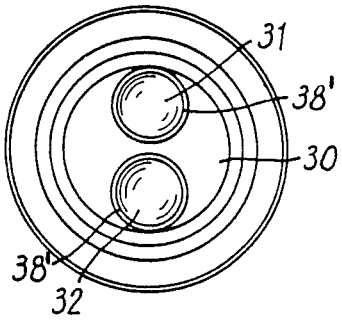
FIG. 6 is a view of the plug from underneath.

Also and according to the invention, the base of the lower tubular portions 7, 17*a* of the plugs 5, 17 of the preceding figures is recessed at 30 and is formed with cells 31, 32 as best shown in FIG. 6.

Figure 5:
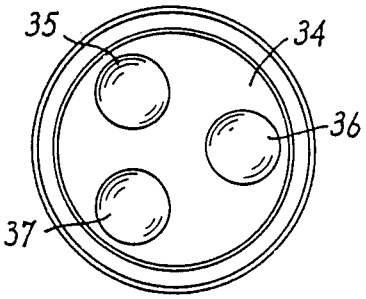
FIG. 5 is a top view of the plug.

The upper portions 7*b*, 17*b* of the same plugs are also formed with an upper circular recess 34 (FIG. 5) containing three cells 35, 36, 37.

Figure 4:
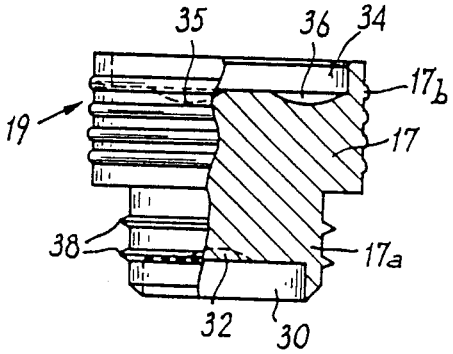
FIG. 4 is an elevation view partly in cross-section of a second embodiment of the plug.

In FIG. 4, a periphery of the upper portion of the plug 17 includes one or several rings 19 for cooperating with the outer skirt 12.

For ensuring a better tightness of the plug 17 in the flask neck or on the tube upper portion, it is also possible to provide rings of triangular section 38.

Moreover, it is possible to make, around the cells 31, 32, 35, 36 and 37, an edge or rim 38' (FIG. 6) for retaining the small spheres forming each one an element of the intake of a drug in consideration.

The present invention is, of course, in no way restricted to the specific disclosure of the specification and drawing, but also encompasses any modifications within the scope of the appended claims.

I claim:

1. A plug for closing a container, especially a tube or flask that contains pharmaceutical products, with said plug being adapted, in turn, to be covered by an outer cap; said plug comprising:

a lower tubular portion that is adapted to fit into an upper portion of said container; said lower tubular portion has a recessed portion that is provided with first cells for temporarily retaining said pharmaceutical products; and an upper portion that is connected to said lower tubular portion and has a peripheral outer edge that is provided with first protruding means adapted to cooperate with second protruding means on an inner portion of said outer cap; said upper portion has an upper circular recessed portion that is remote from said recessed portion of said lower tubular portion and that is provided with second cells for temporarily retaining said pharmaceutical products.

2. A plug according to claim 1, in which said first protruding means of said upper portion of said plug is a flared-out portion, and said cooperating second protruding means of said outer cap are beads.

3. A plug according to claim 1, in which said first protruding means of said upper portion of said plug is in the form of at least one ring, and said cooperating second protruding means of said outer cap are bulges.

4. A plug acording to claim 1 in combination with an outer cap, in which at least some of said cells are provided with a rim therearound.

5. A plug according to claim 1 in combination with an outer cap, in which said outer cap has a top portion, remote from said container, that is centrally provided with a space, defined by a circular edge, for receiving an identifying label.

6. A plug according to claim 1 in combination with an outer cap, in which said second protruding means of said outer cap comprise a plurality of protrusions that are uniformly distributed at a distance from one another on said inner portion of said cap.

7. A plug and outer cap according to claim 6, in which said protrusions are disposed at an angle of 180° relative to one another.

8. A plug and outer cap according to claim 6, in which said protrusions are disposed at an angle of 120° relative to one another.

9. A plug and outer cap according to claim 6, in which said protrusions are disposed at an angle of 90° relative to one another.

10. A plug according to claim 1, in which said lower tubular portion of said plug is in the form of a skirt having a slightly frustoconical outer wall, and in which said upper portion of said plug includes an overthickness that provides said first protruding means in the form of a flared-out peripheral edge.

11. A plug according to claim 1, in which said upper portion of said plug is provided with rings as said first protruding means, with said rings adopted to cooperate with said second protruding means, of said cap, which are in the form of bulges.

12. A plug according to claim 1, in which said lower tubular portion of said plug is provided on an outer surface thereof with peripheral rings that have an essentially triangular cross-sectional shape.

* * * * *

UNITED STATES PATENT AND TRADEMARK OFFICE

CERTIFICATE OF CORRECTION

PATENT NO. : 4,765,379

DATED : August 23, 1988

INVENTOR(S) : Patrice Szymanski

It is certified that error appears in the above-identified patent and that said Letters Patent is hereby corrected as shown below:

Column 4, line 54, cancel "adopted" and insert -- adapted --.

Signed and Sealed this

Twenty-fourth Day of January, 1989

*Attest:*

DONALD J. QUIGG

*Attesting Officer*

*Commissioner of Patents and Trademarks*